US005783769A

United States Patent [19]

Goleniewski et al.

[11] Patent Number: 5,783,769

[45] Date of Patent: Jul. 21, 1998

[54] SOLID PROPELLANT WITH NON-CRYSTALLINE POLYETHER/ENERGETIC PLASTICIZER BINDER

[75] Inventors: John R. Goleniewski, Sandy; James A. Roberts, Salt Lake City, both of Utah

[73] Assignee: Hercules Incorporated, Wilmington, Del.

[21] Appl. No.: 326,852

[22] Filed: Mar. 17, 1989

[51] Int. Cl.[6] ..... C06B 45/10

[52] U.S. Cl. ..... 149/19.6; 149/19.4

[58] Field of Search ..... 149/19.4, 19.6

[56] References Cited

U.S. PATENT DOCUMENTS

| | | | |
|---|---|---|---|
| 3,809,585 | 5/1974 | Greenberg | 149/19.4 |
| 4,483,978 | 11/1984 | Manser | 149/19.4 |
| 4,707,540 | 11/1987 | Manser et al. | 528/417 |
| 4,764,586 | 8/1988 | Manser et al. | 149/19.4 |
| 4,799,980 | 1/1989 | Reed | 149/19.4 |
| 4,804,424 | 2/1989 | Hinshaw | 149/19.6 |
| 4,806,613 | 2/1989 | Wardle | 149/19.6 |
| 5,067,996 | 11/1991 | Lundstrom et al. | 149/19.4 |
| 5,099,042 | 3/1992 | Wardle et al. | 149/19.6 |
| 5,348,596 | 9/1994 | Goleniewski et al. | 149/19.6 |

*Primary Examiner*—Edward A. Miller
*Attorney, Agent, or Firm*—Mark Goldberg

[57] ABSTRACT

A solid propellant composition of an oxidizer, a fuel, a binder, and at least one other additive has an improved binder system comprising a non-crystalline polyether having a molecular weight of 1250–9000 (such as Teracol TE and ER-1250/25) and an energetic plasticizer (such as BuNENA, EthylNENA, TEGDN, and DEGDN plasticizers). Propellants of this invention can be used, for example, in ground-launched interceptors, air launched tactical motors, and space boosters.

3 Claims, No Drawings

SOLID PROPELLANT WITH NON-CRYSTALLINE POLYETHER/ENERGETIC PLASTICIZER BINDER

BACKGROUND OF THE INVENTION

This invention relates to solid composite propellant compositions composed of an oxidizer a fuel, a binder and at least one other additive.

Prior to the present invention, the state-of-the-art in solid propellants for man-rated or Department of Defense (DoD) class 1.3 applications were those containing an inert hydroxy-terminated polybutadiene (HTPB) binder. These formulations generally contain 86 to 88% solids and use ammonium perchlorate oxidizer. They may also use an inert plasticizer such as dioctyl sebacate (DOS) or dioctyl adipate (DOA), aluminum fuel, and solid cyclic nitramines such as cyclotetramethylene tetranitramine (HMX) or cyclotrimethylene trinitramine (RDX). The HTPB propellants are useful because they are less expensive and safer to use than double-base propellants which are DoD class 1.1 (mass-detonable). However, they are also less energetic and consequently have lower performance than a state-of-the-art nitrate ester polyether (NEPE) double-base propellant.

HTPB propellants also have low electrical conductivities (or high resistivities) which makes them susceptible to catastrophic dielectric breakdown and other electrostatic hazards. Electrostatic discharge is known to have been the cause of disastrous fires which have occurred during the handling and manufacture of prior art rocket motors, that contain HTPB propellant.

Propellants containing HTPB binder are also considered to be marginal with respect to low temperature strain capability. A cold (−25° F.) ignition strain requirement of at least 40% is expected for future ground-launched tactical and strategic missiles. The highest performing HTPB propellant (89% solids) is only capable of about 40% strain under those conditions.

SUMMARY OF THE INVENTION

The present invention is directed to a solid propellant composition specifically designed to overcome the inherent disadvantages of composite propellants based on an HTPB binder. The solid propellant composition of the present invention comprises an oxidizer, a fuel, a binder, and at least one additive, selected from a stabilizer, burning rate additive, bonding agent, scavenger, or catalyst; the improvement of this propellant over the prior art comprises using a binder comprising, (based on the weight of the total propellant composition) of (a) from about 3 to about 12% of a non-crystalline polyether having a molecular weight of from about 1250 to about 9,000 and (b) from about 1 to about 12% of an energetic plasticizer such as n-butyl-2-nitratoethyl nitramine, ethyl-2-nitratethylnitramine, triethylene glycol dinitrate, diethylene glycol dinitrate, and nitroglycerin.

DETAILED DESCRIPTION OF THE INVENTION

The binder of the propellant of the present invention is for a new family of DoD Class 1.3 propellants using the combination of an energetic plasticizer and a non-crystalline ("soft segment") polyether. Propellants of this invention are used for ground-launched interceptors, air-launched tactical motors, and space boosters (SRMs). Other uses of the propellant of this invention are for formulating into strategic, tactical, reduced smoke, and minimum smoke propellants and insensitive munitions.

Energetic plasticizers are defined as those liquid materials having a positive heat of explosion (HEX). Heat of explosion is the energy released by burning the propellant or ingredient in an inert atmosphere (e.g., 20 atm $N_2$) and then cooling to amibient temperatures in a fixed volume. Examples of the energetic plasticizer are BuNENA (n-butyl-2-nitratoethyl nitramine) (HEX=+259.3 cal./g), EthylNENA (ethyl-2-nitratoethyl nitramine) (HEX=+783.9 cal./g), triethylene glycol dinitrate (TEGDN) (HEX=+604.0 cal./g), diethylene glycol dinitrate (DEGDN) (HEX=+1022.13 cal./g), nitroglycerin (HEX=+1755.60 cal./g), and other liquid nitrate esters.

Examples of the non-crystalline polyether include random copolymers of ethylene oxide and tetrahydrofuran ranging in molecular weight from 1250 to 2000 and ethylene oxide content from 15–40% by weight. These polyethers are available commercially from DuPont Inc. as Teracol TE 2000 (molecular weight=2000, ethylene oxide=38% and tetrahydrofuran=62%) and from the BASF Corporation as ER-1250/25 (molecular weight=1250, ethylene oxide=25% and tetrahydrofuran=75%).

The non-crystalline polyethers of this invention are polar enough to accommodate the energetic plasticizers necessary for higher specific impulse (Isp). These same plasticizers are not miscible with the relatively non-polar HTPB polymer. Consequently, potentially higher performance can be attained with a propellant containing a non-crystalline polyether/energetic plasticizer combination (relative to a state-of-the-art HTPB propellant).

The non-crystalline polyether also allows for the formulation of propellants with much lower plasticizer levels (propellants with plasticizer-to-polymer ratios of 0.3 have been successfully formulated) relative to a propellant made with highly crystalline polyethers such as polyethylene glycol (PEG) and polytetrahydrofuran (PTHF).

Propellants of the present invention have excellent low temperature mechanical properties. The low plasticizer levels attainable with the non-crystalline polyethers have facilitated the formulation of propellants with high solids loadings and bonding agents. Compositions have been made with solids loadings as high as 87%. The high solids loadings attainable with these binders has improved the overall performance (i.e., volumetric impulse) of the propellants by raising the density.

Conversely, the solids loading of propellants of the present invention can also be decreased to as low as 74% by weight (relative to an HTPB propellant) to achieve superior mechanical properties without sacrificing performance. A propellant formulated with the binder system of ER-1250/25 and BuNENA at 83% solids not only has greatly superior ignition strain at −25° F. relative to an 88% solids HTPB propellant, but also has higher performance.

Since the non-crystalline polyethers of the present invention will accommodate low levels of high energy plasticizers, the formulation of DoD Class 1.3 (man-rated) propellants is also facilitated. High performance Class 1.3, zero card gap propellants have been formulated with plasticizers such as nitroglycerin and triethylene glycol dinitrate. Historically, propellants containing these plasticizers have been highly detonable (DoD Class 1.1)

Propellants containing the non-crystalline polyether/energetic plasticizer binder of the instant invention are also considerably more conductive than their HTPB counterparts. Consequently, static electricity is dissipated much more rapidly with these formulations. Therefore, the likelihood of catastrophic dielectric breakdown or some other electrostatic hazard is greatly reduced with the polyether propellants of the present invention.

The general compositional ranges of propellants of this invention containing the non-crystalline polyether and energetic plasticizer is illustrated in Table I as follows:

TABLE I

General Compositional Ranges (Weight %) for Propellant Containing Non-Crystalline Polyether and Energetic Plasticizer

| | |
|---|---|
| Solids Loading | 74–87% |
| Non-crystalline Polyether (molecular weight 1250–9000) | 3–12% |
| Energetic Plasticizer (e.g., TEGDN or BuNENA) | 1–12% |
| Bonding Agent (*e.g., BHEGA[a] or Epoxy/Amine[b]) | 0–0.3% |
| Difunctional Isocyanate (Curing Agent) (e.g., IPDI[c], HDI[d], DDI[e]) | 0.5–2.0% |
| Polyfunctional Isocyanate (Curing Agent) (e.g., N100, L2291A both available commercially from Mobay) | 0.1–0.8% |
| Ammonium Nitrate Oxidizer | 0–60% |
| Ammonium Perchlorate Oxidizer | 0–60% |
| Sodium Nitrate Scavenger | 0–60% |
| Miscellaneous Oxidizer (e.g., hydrazine nitrate, lithium nitrate) | 0–60% |
| Cyclic Nitramine (e.g. HMX or RDX) | 0–20% |
| Fuel (e.g. Al, Mg, and Zr powders) | 2–24% |
| Cure Catalyst (e.g., triphenyl bismuth, maleic anhydride & tris-para-ethoxyphenyl bismuth) | 0–0.1% |
| Nitrate Ester Stabilizer (e.g. N-methyl-p-nitroaniline (MNA) & 2-nitrodiphenyl amine (2-NDPA) | 0.1–0.6% |
| Burning Rate Additive (e.g., $Fe_2O_3$, $Al_2O_3$ & $Cr_2O_3$) | 0–4.0% |

[a]BHEGA = Bis-hydroxyethyl glycolamide, marketed by 3M as Dynamar HX-880
[b]Epoxy-Amine = 0.06% DER 331 (bis-phenol-A epoxy resin) and 0.04% of triethylenetetramine (hardener)
[c]IPDI is isophorone diisocyanate
[d]HDI is hexamethylene diisocyanate
[e]DDI = dimeryl diisocyanate (difunctional curative)

As long as the propellant composition of this invention is mixed together in a reasonable length of time, there is no particular order to mixing the components together.

The following examples will illustrate the composition of specific embodiments of the propellant and comparative data with similar prior art compositions. Parts and percentages are by weight unless otherwise specified.

EXAMPLE 1

A "clean" (no hydrochloric acid in the exhaust) propellant formulation (AP oxidixed/sodium nitrate scavenged) for a large solid rocket motor or space booster has the composition shown in Table II below. This formulation contains ER-1250 non-crystalline polyether and BuNENA energetic plasticizer. The properties of this formulation are compared to an 88% solids HTPB propellant (also AP/sodium nitrate oxidized/scavenged) in Table III below. The performance of the propellant containing the polyether is significantly higher (+4.0 sec. Isp, +0.001 lb/in$^3$ density) than its 88% solids HTPB counterpart. Both the polyether and HTPB clean propellant formulations have a Class 1.3 (Zero cards—NOL card gap) DOT hazards classification. However, the BuNENA propellant is five orders-of-magnitude more conductive (five orders-of-magnitude lower volume resistivity), making it far less susceptible to ESD ignition (catastrophic dielectric breakdown), relative to the HTPB propellant. The mechanical properties for the BuNENA clean propellant are superior as illustrated in Table III, particularly ignition strain at 40° F.

TABLE II

| | PERCENTAGES (by wt.) EXAMPLE | | | | |
|---|---|---|---|---|---|
| COMPONENTS | 1 | 2 | 3 | 4 | 5 |
| ER-1250/25 | 6.649 | 6.649 | | | |
| TERACOL TE | | | 6.042 | 8.801 | 5.946 |
| BuNENA | 8.5 | | 8.5 | 8.0 | 8.5 |
| TEGDN | | 8.5 | | | |
| MNA | 0.1 | 0.1 | 0.4 | 0.2 | 0.4 |
| BHEGA | 0.1 | 0.1 | | | |
| IPDI | 1.240 | 1.240 | | | |
| N100 | 0.311 | 0.311 | 0.589 | 0.687 | 0.348 |
| Triphenyl Bismuth | 0.05 | 0.05 | 0.05 | 0.05 | 0.05 |
| Maleic Anhydride | 0.05 | 0.05 | 0.05 | 0.05 | 0.05 |
| Ammonium Perchlorate | 35.1 | 35.1 | 51.5 | 51.0 | 60.0 |
| Sodium Nitrate | 25.4 | 25.4 | | | |
| Aluminum Powder | 22.5 | 22.5 | 21.5 | 19.0 | 23.0 |
| Epoxy-amine (bonding agent) | | | 0.10 | 0.10 | 0.10 |
| DDI | | 1.269 | 2.112 | 1.606 | |
| RDX | | | 10.0 | 10.0 | |

TABLE III

HTPB/DOS (88% Solids) vs ER-1250 BuNENA (83% Solids) "Clean" SRM Propellant Properties

| | HTPB/DOS (88% Solids) (Prior Art) | ER-1250/BuNENA (83% Solids) |
|---|---|---|
| Performance | | |
| I°sps[a] [lb(f)-sec/lb(m)] | 243.0 | 247.0 |
| Density (lb/in$^3$) | 0.067 | 0.068 |
| OMOX[b] | 1.26 | 1.25 |
| Mechanical Properties[c] | | |
| 2 in./min (ipm)/77° F. | | |
| δm, psi | 116 | 134 |
| εm, % | 31 | 37 |
| E, psi | 534 | 519 |
| 100 ipm/40° F/ 1000 psi | | |
| εm, % | 40 | 73 |
| Safety | | |
| NOL Card Gap Test # Cards) | 0 | 0 |
| Critical Diameter | >3 inches | >3 inches |
| Volume Resistivity (ohm-cm) | $10^{13}$ | $10^{8}$ |

[a]I°sps is the theoretical specific impulse at sea level.
[b]IMOX, in a propellant formulation, is defined as the ratio of the moles of oxygen to the sum of the moles of carbon plus 1.5 times the moles of aluminum.
OMOX = moles $O_2$/(moles C + 1.5 moles Al); this parameter is widely used for correlations of rocket propellant performance.
[c]All mechanical properties were obtained using tensile test machines such as Instron or Teriatek.

EXAMPLE 2

A second space booster "clean" propellant of this invention contains ER-1250 non-crystalline polyether and triethylene glycol dinitrate (TEGDN) energetic plasticizer. The composition of this formulation is shown in Table II. The properties of this propellant are again compared to the scavenged 88% solids HTPB propellant (Table IV below). The performance of the propellant containing the non-crystalline polyether/TEGDN combination is significantly higher (+1.7 sec. Isp, +0.002 lb/in$^3$ density) than that of its HTPB counterpart. Both the polyether and HTPB clean propellant formulations have a Class 1.3 (Zero cards—Naval Ordinance Lab.(NOL) card gap test) DOT hazards classification. However, the polyether propellant is again five orders-of-magnitude more conductive, making it less susceptible to ESD ignition. The mechanical properties for the polyether/TEGDN clean propellant are again superior as illustrated in Table IV, particularly ignition (100 ipm @ 1000 psi) strain at 40° F.

TABLE IV

HTPB/DOS (88% Solids) vs ER-1250/TEGDN (83% Solids) "Clean" SRM Propellant Properties

| | HTPB/DOS (88% Solids) (prior art) | ER-1250/TEGDN (83% Solids) |
|---|---|---|
| Performance | | |
| I°sps [lb(f)-sec/lb (m)] | 243.0 | 244.7 |
| Density (lb/in$^3$) | 0.067 | 0.069 |
| OMOX | 1.26 | 1.32 |
| Mechanical Properties | | |
| 2 ipm/77° F. | | |
| δm,psi | 116 | 135 |
| εm, % | 31 | 46 |
| E, psi | 534 | 469 |
| 100 ipm/40° F./1000 psi | | |
| εm, % | 40 | 82 |
| Safety | | |
| NOL Card Gap Test (# Cards) | 0 | 0 |
| Critical Diameter (ohm/cm) | 3 inches | 3 inches |
| Volume Resistivity | $10^{13}$ | $10^{8}$ |

EXAMPLE 3

An 83% solids propellant formulated for a ground-launched interceptor contained Teracol TE non-crystalline polyether and BuNENA energetic plasticizer (see Table II for exact composition). This formulation has higher performance (+0.4 sec Isp) than a state-of-the-art HTPB propellant (89% solids, 16% HMX) developed for the same application (see Table V). The BuNENA propellant elongation at −25° F. under high strain rate (100 in/min crosshead speed) and 1000 psi is 61%. This is far superior to a value of 40% measured for the HTPB formulation. The low temperature thermal strain (2 in/min crosshead speed at −25° F.) is also superior for the BuNENA propellant (55% vs 30%). Although both propellants are man-rated (DoD Class 1.3, zero card gap), the non-crystalline polyether/BuNENA propellant is far more conductive (lower volume resistivity), making it less susceptible to ESD ignition.

TABLE V

HTPB (89% Solids) vs Teracol TE/BuNENA (83% Solids) Interceptor Propellant Properties

| | HTPB/DOS (89% Solids 16% HMX) | Teracol TE/BuNENA (83% solids 10% RDX) |
|---|---|---|
| Performance | | |
| I°sps [lb(f) sec/lb(m)] | 265.8 | 266.2 |
| Density (lb/in$^3$) | 0.065 | 0.065 |
| OMOX | 1.17 | 1.16 |
| Mechanical Properties | | |
| 2 ipm/77° F. | | |
| δm, psi | 109 | 85 |
| εm, % | 29 | 27 |
| E, psi | 668 | 646 |
| 2 ipm/−25° | | |
| δm, psi | 219 | 200 |
| εm, % | 30 | 55 |
| E, psi | 1699 | 1140 |
| 100 ipm/−25°/ 1000 psi | | |
| εm, % | 40 | 62 |
| Safety | | |
| NOL Card Gap Test (# Cards) | 0 | 0 |
| Volume Resistivity (ohm-cm) | $10^{13}$ | $10^{8}$ |

EXAMPLE 4

A formulation containing Teracol TE and BuNENA was formulated at 80% solids for an ultra-low burning rate interceptor propellant. The exact composition for this propellant is given in Table II. This formulation has higher performance (+1.5 sec Isp) than a state-of-the art HTPB propellant (87% solids, 4% HMX) developed for the same application (see Table VI). Improved conductivity (lower volume resistivity) and low temperature mechanical properties (−25° F. thermal and ignition strain) were also noted with this propellant relative to its HTPB counterpart.

TABLE VI

HTPB (87% Solids) vs Teracol TE/BuNENA (80% Solids) Interceptor Propellant Properties

| | HTPB/DOS (87% Solids 4% HMX) | Teracol TE/BuNENA (80% solids 10% RDX) |
|---|---|---|
| Performance | | |
| I°sps [lb(f) sec/lb(m)] | 264.1 | 265.6 |
| Density (lb/in$^3$) | 0.064 | 0.064 |
| OMOX | 1.17 | 1.15 |
| Mechanical Properties | | |
| 2 ipm/77° F. | | |
| δm, psi | 41 | 70 |
| εm, % | 27 | 21 |
| E, psi | 236 | 561 |
| 2 ipm/−25° | | |
| δm, psi | 78 | 176 |

TABLE VI-continued

| HTPB (87% Solids) vs Teracol TE/BuNENA (80% Solids) Interceptor Propellant Properties | | |
|---|---|---|
| | HTPB/DOS (87% Solids 4% HMX) | Teracol TE/BuNENA (80% solids 10% RDX) |
| εm, % | 37 | 44 |
| E, psi | 754 | 1036 |
| 100 ipm/−25°/ 1000 psi | | |
| εm, % | 49 | 67 |
| Safety | | |
| NOL Card Gap Test (# Cards) | 0* | 0* |
| Volume Resistivity (ohm-cm) | $10^{13}$* | $10^{8}$* |

*Projected values based on similar propellants.

EXAMPLE 5

An 83% solids propellant was also formulated for use in an air-launched tactical motor. This formulation contained Teracol TE non-crystalline polyether and BuNENA energetic plasticizer, but no solid nitramine (HMX or RDX). The exact composition for this propellant is given in Table II. This formulation has higher performance (+0.9 sec Isp), comparable, if not better mechanical properties, and higher conductivity than an 89% solids HTPB propellant (no HMX or RDX) formulated for the same application (see Table VII).

TABLE VII

| HTPB (89% Solids) vs Teracol TE/BuNENA (83% Solids) Air-Launched Propellant Properties | | |
|---|---|---|
| | HTPB/DOS (89% Solids | Teracol TE/BuNENA (83% solids |
| Performance | | |
| I°sps [lb(f) sec/lb(m)] | 263.5 | 264.4 |
| Density (lb/in$^3$) | 0.066 | 0.066 |
| OMOX | 1.23 | 1.20 |
| Mechanical Properties | | |
| 2 ipm/77° F. | | |
| δm, psi | 85 | 145 |
| εm, % | 35 | 45 |
| E, psi | 419 | 431 |
| 100 ipm/−25° F./ 1000 psi | | |
| εm, % | 49 | 58 |
| 100 ipm/−45° F./ 1000 psi | | |
| εm, % | 37 | 40 |
| 100 ipm/−65° F./ 1000 psi | | |
| εm, % | 16 | 18 |
| Safety | | |
| NOL Card Gap Test (# Cards) | 0* | 0* |
| Volume Resistivity (ohm-cm) | $10^{13}$* | $10^{8}$* |

*Projected values based on similar propellants.

What is claimed:

1. In a solid propellant composition comprising an oxidizer, a fuel, a binder, and at least one additive selected from a stabilizer, a bonding agent, a burning rate additive, a scavenger or a catalyst, the improvement comprising using a binder comprising based on the weight of the total propellant composition, of (a) 3–12% of a non-crystalline polyether having a molecular weight of 1250–9000 and (b) 1–12% of an energetic plasticizer having a positive heat of explosion, wherein the non-crystalline polyether is selected from random copolymer of ethylene oxide and tetrahydrofuran.

2. The composition of claim 1 wherein the random copolymer has an ethylene oxide moiety content of 15–40% and a molecular weight of 1000–3000.

3. The solid propellant composition of claim 1 wherein the energetic plasticizer is selected from n-butyl-2-nitratoethyl nitramine, ethyl-2-nitratoethyl nitramine, triethylene glycol dinitrate, diethylene glycol dinitrate, and nitroglycerin.

* * * * *

UNITED STATES PATENT AND TRADEMARK OFFICE

CERTIFICATE OF CORRECTION

PATENT NO. : 5,783,769

DATED : July 21, 1998

INVENTOR(S) : John R. Goleniewski; James A. Roberts

It is certified that error appears in the above-identified patent and that said Letters Patent is hereby corrected as shown below:

In Column 1, after the title, insert the following:

-- This invention was made with Government suport under contract DASG60-86-C-0029 awarded by the Department of the Army. The Government has certain rights in this invention.---

Signed and Sealed this

Second Day of February, 1999

*Attest:*

*Acting Commissioner of Patents and Trademarks*

*Attesting Officer*